US006539955B1

(12) United States Patent
Tilton et al.

(10) Patent No.: US 6,539,955 B1
(45) Date of Patent: Apr. 1, 2003

(54) ACOUSTICAL INSULATION BLANKET FOR DISHWASHER

(75) Inventors: Jeffrey Allan Tilton, Goshen, KY (US); Phil J. Johnson, Louisville, KY (US); Gary James Newman, Columbus, OH (US); Kurt G. Melia, Goshen, KY (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/676,163

(22) Filed: Sep. 29, 2000

(51) Int. Cl.[7] ..... B08B 3/02

(52) U.S. Cl. ..... 134/58; 134/201; 134/191; 68/3 R

(58) Field of Search ..... 134/56 D, 57 D, 134/58 D, 201, 191, 186; 68/3 R

(56) References Cited

U.S. PATENT DOCUMENTS

| | | | | |
|---|---|---|---|---|
| 3,295,541 | A | * | 1/1967 | Ummel |
| 3,399,103 | A | * | 8/1968 | Salyer et al. |
| 3,672,188 | A | * | 6/1972 | Geschka et al. |
| 3,739,992 | A | * | 6/1973 | Bebinger |
| 4,461,796 | A | * | 7/1984 | Fukahori et al. |
| 4,901,676 | A | * | 2/1990 | Nelson |
| 4,985,106 | A | | 1/1991 | Nelson |
| 5,044,705 | A | | 9/1991 | Nelson |
| 5,056,341 | A | * | 10/1991 | Mori et al. |
| 5,263,343 | A | * | 11/1993 | Lee |
| 5,503,172 | A | * | 4/1996 | Hedeen et al. |
| 5,515,702 | A | * | 5/1996 | Park |
| 5,632,543 | A | * | 5/1997 | McGrath et al. |
| 4,985,106 | A | | 6/1997 | Neslon |
| 5,755,900 | A | * | 5/1998 | Weir et al. |
| 5,965,851 | A | * | 10/1999 | Herreman et al. |

FOREIGN PATENT DOCUMENTS

| | | | |
|---|---|---|---|
| DE | 42 27 957 | | 2/1994 |
| DE | 4227957 | * | 2/1994 |
| JP | 1-209098 | * | 8/1989 |
| JP | 2-224700 | * | 9/1990 |

OTHER PUBLICATIONS

European Patent Office 252,024 6–19987.*
Europena Patent Office 381,586 Feb. 1990.*
European Patent Office 561,201 Mar. 1993.*
European Patent Office 992,975 Oct. 1999.*
European Patent Office 335,154 3–1989.*

* cited by examiner

*Primary Examiner*—Frankie L. Stinson
(74) *Attorney, Agent, or Firm*—Inger H. Eckert; Stephen W. Barns

(57) ABSTRACT

A dishwasher includes a housing having a washing chamber and a door for gaining access to the washing chamber. A washing nozzle is provided in the washing chamber for directing a fluid stream against dishes held in the washing chamber. A circulation pump circulates fluid under pressure through the washing nozzle. A supply line delivers fluid to the circulation pump while a drain line discharges fluid from the washing chamber. Additionally the dishwasher includes an acoustical insulation blanket of thermoplastic material. That blanket extends around the washing chamber and the circulation pump and is precisely cut to fit snugly around the fluid supply line and the drain line so as to eliminate gaps therebetween and the acoustical leaks associated therewith. A method is also disclosed for enclosing the noise-generating components of the dishwasher in an acoustical insulation blanket of thermoplastic material.

6 Claims, 2 Drawing Sheets

ACOUSTICAL INSULATION BLANKET FOR DISHWASHER

TECHNICAL FIELD AND INDUSTRIAL APPLICABILITY OF THE INVENTION

The present invention relates generally to dishwasher technology and, more particularly, to a method of insulating a dishwasher with an acoustical insulation blanket of thermoplastic material and a dishwasher so insulated.

BACKGROUND OF THE INVENTION

Automatic dishwashers have long been known as a particularly convenient and efficient way to clean dishes following their use. Such dishwashers generally include a washing chamber for holding the dishes and one or more streams of pressurized fluid for washing food and drink residue from the dishes. Unfortunately, the washing process generates considerable noise, which can be quite annoying to the user. In an effort to reduce this noise it has long been known to provide dishwashers with acoustical insulation.

Conventional acoustical insulation systems for dishwashers generally comprise sound transmission barriers and sound absorption layers. Typically, acoustical insulation involves enclosing the noise source in an insulation structure. A typical form of acoustical insulation is a layer of mineral fiber insulation, such as fiberglass insulation, wrapped around or positioned around the source of unwanted noise. For example, a fiberglass absorber is usually incorporated in the front door panel of an under-the-counter dishwasher. The blanket of glass fibers absorbs some of the sound energy entering the fiberglass board, thereby resulting in a reduced transmission of unwanted sound from the source of the sound in the dishwasher.

While useful for its intended purpose, fiberglass absorbers suffer from a number of shortcomings. Fiberglass material may potentially cause skin irritations when repeatedly handled. In order to address this problem and protect manufacturing employees who repeatedly handle the fiberglass insulation boards, the boards are now encapsulated in a polyethylene or like film. Such an arrangement is disclosed in U.S. Pat. Nos. 4,985,106 and 5,044,705. Although effective for protecting individuals from contact with the fiberglass material, this processing does not allow for exact fit and function when the board is installed on a dishwasher. Specifically, cutout areas such as those provided around water supply and drain lines must be oversized to allow for the encapsulation process. These oversized cutout areas leave gaps between the fiberglass board and the projecting structures that often impair the acoustical performance of the material.

Further, the polyethylene outer film has a tendency to catch on objects. This complicates the packaging of the dishwasher by the manufacturer. Specifically, corner posts and boxes are used to package the finished under-the-counter dishwasher and the exposed polyethylene layer may catch and tear exposing the fiberglass insulation. Of course, the outer polyethylene layer or film may also be torn when installing or removing the dishwasher for repair. As noted above such tears expose bare fiberglass potentially causing irritation to the worker or homeowner. As a further consideration, the resulting poor appearance may also adversely affect customer satisfaction with the dishwasher.

Still further, it should be appreciated that the fiberglass board cannot be contour molded. Accordingly, the thickness of the fiberglass used is determined by the minimum clearance point between the outer casing of the dishwasher and the under counter opening for which the dishwasher is designed.

From a review of the above it should be appreciated that a need exists for a dishwasher having improved acoustical insulation as well as for a method of acoustically insulating a dishwasher.

SUMMARY OF THE INVENTION

To achieve the foregoing and other objects and in accordance with the purposes of the present invention as described herein, an improved dishwasher is provided. That dishwasher includes a housing having a washing chamber and a door for gaining access to the washing chamber. A washing nozzle is provided in the washing chamber. The nozzle functions to direct a fluid stream against dishes held in the washing chamber. A circulation pump circulates fluid under pressure through the washing nozzle. The dishwasher also includes a supply line for delivering fluid to the circulation pump and a drain line for discharging fluid from the washing chamber.

Still further, the dishwasher includes an acoustical insulation blanket of thermoplastic material. The acoustical insulation blanket extends around the washing chamber and the circulation pump and is precisely cut to fit snugly around the fluid supply line and the drain line so as to eliminate gaps therebetween and the acoustical leaks associated therewith.

The thermoplastic material utilized for the acoustical insulation blanket is selected from a group of fibers consisting of polyester, polyolefin, polyethylene, rayon, nylon, acrylic, hemp, kenaf, cotton and combinations thereof. The acoustical insulation blanket may be composed of polyester staple fibers and polyester bicomponent fibers of distinct diameters typically between 8.0 and 50.0 microns and distinct lengths typically between 0.5 and 3.0 inches. The acoustical insulation blanket may also include melt blown microfibers.

Still further the acoustical insulation blanket may include a facing layer such as a scrim in order to protect the material during handling of the dishwasher. Alternatively or in addition, the acoustical insulation blanket may include a relatively high-density skin on at least one face thereof for the same purpose.

In accordance with yet another aspect of the present invention, a method is provided for insulating a dishwasher. The method comprises the step of enclosing the noise generating components of the dishwasher in an acoustical insulation blanket of thermoplastic material.

Still further, the method may include the step of precisely cutting the acoustical insulation blanket to fit snugly around selected projecting structures so as to eliminate gaps between the blanket and the structures and, therefore, acoustical leaks associated with those gaps.

Still further, the method may include the step of contour molding the acoustical insulation blanket to a desired shape. Further, the method includes the crimping of the acoustical insulation blanket in selected areas. Together, the contour molding and crimping allow a custom fit for any particular application and thereby ensure that acoustical insulating efficiencies of the material are maximized.

Still other objects of the present invention will become readily apparent to those skilled in this art from the following description wherein there is shown and described several embodiments of this invention simply by way of illustration of some of the modes best suited to carry out the invention.

As it will be realized, the invention is capable of other different embodiments and its several details are capable of modification in various, obvious aspects all that departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing:

FIG. 1*a* is a schematic view in partially cut away perspective of a dishwasher incorporating a novel acoustical insulation blanket;

Reference will now be made in detail to the present preferred embodiment of the invention, an example of which is illustrated in the accompanying drawing.

DETAILED DESCRIPTION AND PREFERRED EMBODIMENTS OF THE INVENTION

Figure 1B:
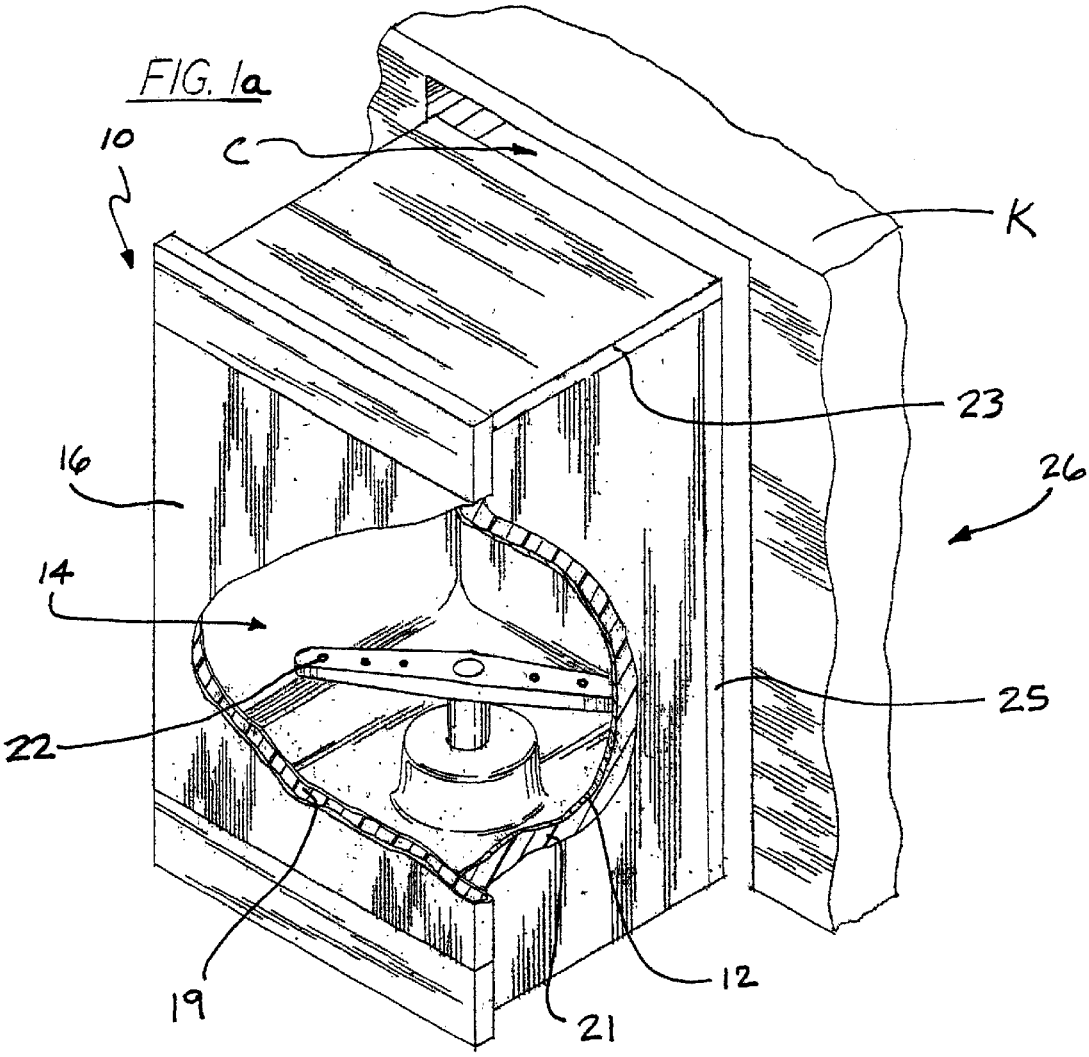
FIG. 1*b* is a schematic, detailed elevational view showing the snug fit of the acoustical insulation blanket around the supply and drain lines.
Figure 1B:
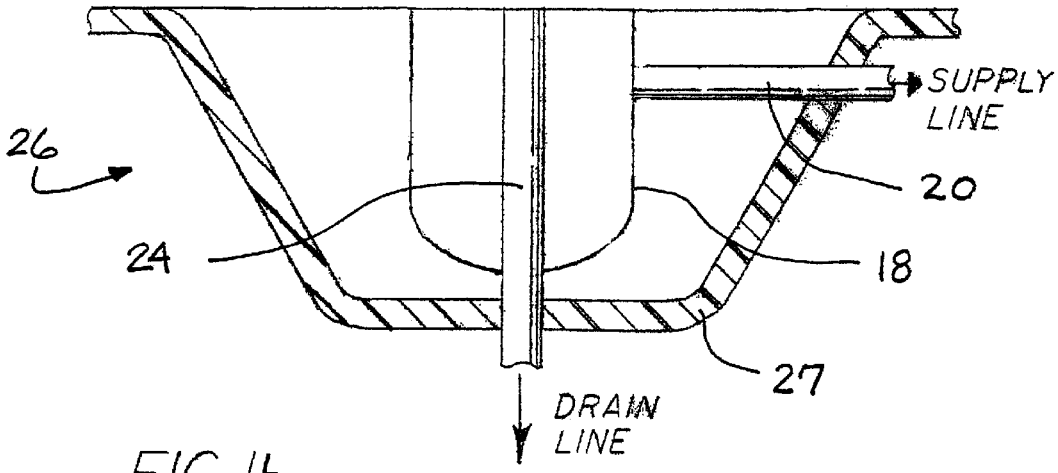

Reference is now made to FIGS. 1 and 1*a* showing a dishwasher 10. Dishwasher 10 includes a housing or cabinet 12 including a washing chamber 14 and a door 16. The door 16 may be opened in order to gain access to the washing chamber 14 into which dishes are placed for washing. The dishwasher 10 is an under-the-counter design suitable for insertion and mounting in a cavity C formed in a kitchen cabinet K.

The dishwasher 10 also includes a circulation pump 18. The circulation pump 18 circulates fluid, such as wash water, from a supply line 20 to a washing nozzle 22 provided in the washing chamber 14. The washing nozzle 22 directs the fluid stream against the dishes held in the washing chamber 14 so as to scrub and lift food and drink residue from the dishes and provide the desired cleaning action. A drain line 24 discharges fluid entrained with food and drink residue and debris from the washing chamber 14.

An acoustical insulation blanket 26 of thermoplastic material extends around the washing chamber 14 and the circulation pump 18 on the housing 12. FIGS. 1 and 1*a* specifically show the acoustical insulation blanket 26 in the form of panels including door panel 19 behind facing 29, side insulation panel 21, top insulation panel 23, rear insulation panel 25 and bottom panel 27. Similar panels (not shown), may be provided on the opposite side and bottom of the dishwasher 10. Further, while the insulation panels 19, 21, 23 and 25 are shown as individual pieces or elements, it is to be understood that these panels could be formed as one piece or in any other configuration suitable for providing acoustical insulation for the dishwasher 10.

The thermoplastic material of the acoustical insulation blanket 26 is selected from a group of fibers consisting of polyester, polyolefin, polyethylene, rayon, nylon, acrylic, hemp, kenaf, cotton and combinations thereof. In one particularly useful embodiment the acoustical insulation blanket 26 is composed of polyester stable fibers and polyester bicomponent fibers. These fibers have distinct diameters of between about 8.0–50.0 microns and distinct lengths of between about 0.5 and 3.0 inches. It should be appreciated, however, that the blanket may also include melt blown microfibers if desired.

Figure 2A:
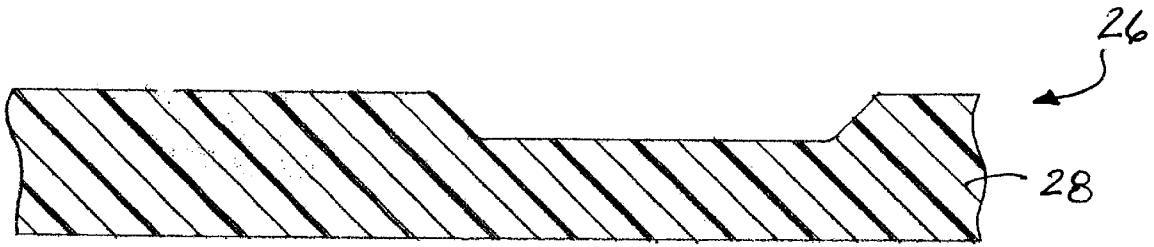
FIG. 2*a* is a cross sectional view of a first embodiment of the acoustical insulation blanket.
Figure 2B:
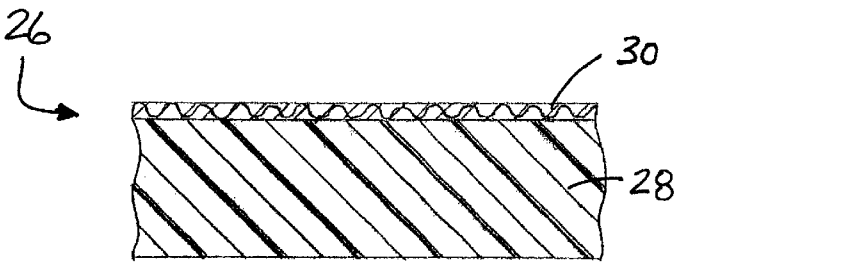
FIG. 2*b* is a cross sectional view of a second embodiment of the acoustical insulation blanket.

As shown in FIG. 2*a*, the acoustical insulation blanket 26 may comprise a single layer 28 of the thermoplastic material. The thermoplastic material may be of a consistent or varying density across its thickness. In a second embodiment shown in FIG. 2*b*, the acoustical insulation blanket 26 may include an outer facing layer 30, which may be bonded by adhesive or other means to the thermoplastic material layer 28. While not to be considered limiting, the facing layer 30 may be made from polyester, polypropylene, rayon, nylon, metallic foil or any combination thereof. The facing 30 may also be reinforced or non-reinforced. Reinforcements add durability and structural integrity. Reinforcements may take the form of fibrous scrims, fibrous mats or fibrous webs.

Figure 2C:
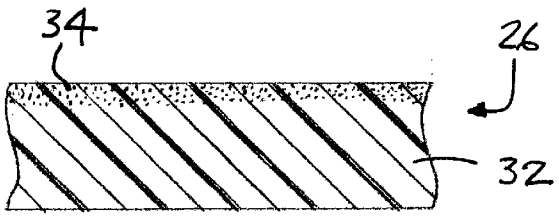
FIG. 2*c* is a cross sectional view of a third embodiment of the acoustical insulation blanket.

In accordance with yet another embodiment of the invention shown in FIG. 2*c*, the acoustical insulation blanket may comprise a single layer of thermoplastic material 32 with a relatively high density outer skin 34. Such a construction may be achieved by searing and/or layering in accordance with the forming processes disclosed and described in co-pending U.S. patent application Ser. No. 09/607,478, entitled Process for Forming a Multilayer, Multidensity Composite Insulator, filed on Jun. 30, 2000, herein incorporated by refference.

Figure 2D:
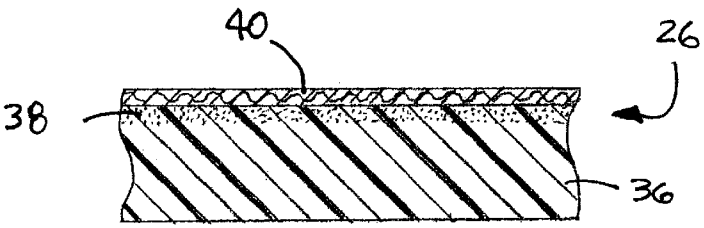
FIG. 2*d* is a cross sectional view of a fourth embodiment of the acoustical insulation blanket.

In accordance with yet another embodiment shown in FIG. 2*d*, the acoustical insulation blanket 26 may comprise a single layer 36 of thermoplastic material including a relatively high density outer skin 38 and a facing layer 40 of the type described above with regard to the FIG. 2*b* embodiment. The facing layers 30, 40 and high density skins 34, 38 function individually or in combination to provide enhanced handling properties and good puncture and tear resistance. This allows the acoustical insulation blanket 26 to be readily shaped or even contour molded to enhance its fit on the housing 12 of the dishwasher 10. Additionally, it simplifies packaging as neither the facing layer 30, 40 nor the high density skin 34, 38 are prone to tearing in the manner of the polyethylene film used to encapsulate fiberglass insulation as previously utilized in the art. Additionally, the facing layer 30, 40 and/or skin 34, 38 provide a more aesthetically pleasing appearance that is capable of substantially increasing customer satisfaction with the dishwasher 10.

In accordance with the present invention a method of insulating a dishwasher 10 includes a step of enclosing the noise-generating components of the dishwasher in an acoustical insulation blanket 26 of thermoplastic material. The method may be further described as including the step of precisely cutting the acoustical insulation blanket 26 to fit snugly around selected projecting structures so as to eliminate gaps between the blanket and those projecting structures. As a consequence acoustical leaks associated with those gaps are also eliminated and the acoustical insulation properties of the blanket 26 are, therefore, fully realized. Projecting structures around which the acoustical insulation blanket 26 extends include but are not limited to the water supply line 20 leading to the circulation pump 18 and the drain line 24 leading from the washing chamber 14 (see FIG. 1*a*).

The method may also include the step of contour molding the acoustical insulation blanket 26 into a desired shape customized for the particular dishwasher application. Still further the method may include the step of crimping the acoustical insulation blanket 26 in selected areas. Crimping creates areas of very thin, high-density material that is extremely durable. Accordingly, crimping may be provided around attachment points to help lock the blanket 26 in place and prevent fasteners from pulling out. The polymer fiber blanket may also be crimped or contoured to fit around and over protrusions on the dishwashers outer casing thus providing extended acoustical coverage and acoustical seals that are not possible with encapsulated fiberglass insulation materials utilized in the past. Further, because the polymer acoustical insulation blanket 26 may be contoured, the thickness of the acoustical insulation blanket 26 may be maximized at all locations within the limits of available clearance to provide improved acoustical performance. In contrast, prior art fiberglass insulating mats are limited in thickness to the minimum clearance point between the dishwasher housing 12 and the height of the cabinet into which the dishwasher 10 is mounted.

The foregoing description of several preferred embodiments of the invention have been presented for purposes of illustration and description. It is not intended to be exhaustive or to limit the invention to the precise form disclosed. Obvious modifications or variations are possible in light of the above teachings. For example, the acoustical insulation blanket 26 may include a facing layer and/or a skin of relatively high density on both faces, not just one face as shown in the drawing figures. Further, the acoustical insulation blanket 26 may include a pad of vibration barrier insulation material (e.g., asphalt) on the top face, the bottom face and/or between layers.

The embodiments were chosen and described to provide the best illustration of the principles of the invention and its practical application to thereby enable one of ordinary skill in the art to utilize the invention in various embodiments and with various modifications as are suited to the particular use contemplated. Also such modifications and variations are within the scope of the invention as determined by the appended claims when interpreted in accordance with the breadth to which they are fairly, legally and equitably entitled.

What is claimed is:

1. A dishwasher, comprising:

a housing including a washing chamber and a door for gaining access to said washing chamber;

a washing nozzle in said washing chamber for directing a fluid stream against dishes held in said washing chamber;

a circulation pump for circulating fluid under pressure through said washing nozzle;

a supply line for delivering fluid to said circulation pump;

a drain line for discharging fluid from said washing chamber; and an acoustical insulation blanket of thermoplastic material extending around said washing chamber and said circulation pump and precisely made to fit snugly around said fluid supply line and said drain line so as to eliminate gaps therebetween and the acoustical leaks associated therewith.

2. The dishwasher of claim 1, wherein said thermoplastic material is selected from a group of fibers consisting of polyester, polyolefin, polyethylene, rayon, nylon, acrylic, hemp, kenaf, cotton and combinations thereof.

3. The dishwasher of claim 1, wherein said acoustical insulation blanket is composed of polyester staple fibers and polyester bicomponent fibers of distinct diameters and lengths.

4. The dishwasher of claim 1, wherein said acoustical insulation blanket includes melt blown microfibers.

5. The dishwasher of claim 1, wherein said acoustical insulation blanket includes a facing layer.

6. The dishwasher of claim 1, wherein said acoustical insulation blanket includes a relatively high density skin on at least one face.

* * * * *